US008980080B2

(12) United States Patent
Koseoglu et al.

(10) Patent No.: US 8,980,080 B2
(45) Date of Patent: Mar. 17, 2015

(54) SYSTEM AND PROCESS FOR INTEGRATED OXIDATIVE DESULFURIZATION, DESALTING AND DEASPHALTING OF HYDROCARBON FEEDSTOCKS

(75) Inventors: Omer Refa Koseoglu, Dhahran (SA); Abdennour Bourane, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 382 days.

(21) Appl. No.: 13/049,305

(22) Filed: Mar. 16, 2011

(65) Prior Publication Data

US 2011/0226666 A1 Sep. 22, 2011

Related U.S. Application Data

(60) Provisional application No. 61/314,497, filed on Mar. 16, 2010.

(51) Int. Cl.

| | |
|---|---|
| ***C10G 53/04*** | (2006.01) |
| ***C10G 53/14*** | (2006.01) |
| ***C10G 31/08*** | (2006.01) |
| ***C10G 27/04*** | (2006.01) |
| ***C10G 27/00*** | (2006.01) |
| ***C10G 33/02*** | (2006.01) |

(52) U.S. Cl.

CPC ..... *C10G 31/08* (2013.01); *C10G 27/00* (2013.01); *C10G 27/04* (2013.01); *C10G 33/02* (2013.01); *C10G 2300/202* (2013.01)

USPC ..... 208/3; 208/240; 208/45; 208/309; 196/155

(58) Field of Classification Search

USPC ..... 208/39, 45, 208 R, 211, 212, 237, 3; 196/155

See application file for complete search history.

(56) References Cited

U.S. PATENT DOCUMENTS

| | | | |
|---|---|---|---|
| 2,288,395 | A | 6/1942 | Ellis |
| 3,236,883 | A | 2/1966 | Losch |

(Continued)

FOREIGN PATENT DOCUMENTS

| | | | |
|---|---|---|---|
| EP | 1674158 | A1 | 6/2006 |
| WO | 03014266 | A1 | 2/2003 |

(Continued)

OTHER PUBLICATIONS

PCT/US2011/028621, International Search Report and Written Opinion dated May 11, 2011, 12 pages.

*Primary Examiner* — Walter D Griffin
*Assistant Examiner* — Derek Mueller
(74) *Attorney, Agent, or Firm* — Abelman, Frayne & Schwab

(57) ABSTRACT

A system and process for integrated desulfurizing, desalting and deasphalting of hydrocarbon feedstocks is provided. A hydrocarbon feedstock, a water soluble oxidant, and a water soluble catalyst can be introduced in a oxidation zone and retained for a period of time sufficient to achieve the desired degree of desulfurization, or introduced directly into the desalting zone along with wash water. Catalyst and dissolved salt are discharged along with the wastewater effluent from the desalting zone. A hydrocarbon stream including converted hydrocarbons and oxidation by-products is passed to a deasphalting zone. In the deasphalting zone, phase separation occurs, whereby a light phase including desulfurized hydrocarbons are produced, and a heavy phase including asphaltenes and oxidation by-products are discharged, e.g., passed to an asphalt pool.

17 Claims, 4 Drawing Sheets

(56) References Cited

U.S. PATENT DOCUMENTS

| | | | | |
|---|---|---|---|---|
| 3,278,562 | A | 10/1966 | Thigpen et al. | |
| 3,719,589 | A | 3/1973 | Herbstman et al. | |
| 4,097,364 | A | 6/1978 | Egan | |
| 4,097,520 | A | 6/1978 | Slattery | |
| 4,113,661 | A | 9/1978 | Tamm | |
| 4,239,616 | A | 12/1980 | Gearhart | |
| 4,290,880 | A | 9/1981 | Leonard | |
| 4,305,814 | A | 12/1981 | Leonard | |
| 4,411,790 | A | 10/1983 | Arod et al. | |
| 4,428,828 | A | 1/1984 | Bose | |
| 4,430,203 | A | 2/1984 | Cash | |
| 4,482,453 | A | 11/1984 | Coombs et al. | |
| 4,502,944 | A | 3/1985 | Nelson | |
| 4,572,781 | A | 2/1986 | Krasuk et al. | |
| 4,639,308 | A | 1/1987 | Lee | |
| 4,663,028 | A | 5/1987 | Ditman | |
| 4,747,936 | A | 5/1988 | Penning | |
| 4,757,042 | A | 7/1988 | Threlkel | |
| 4,781,819 | A * | 11/1988 | Chirinos et al. | 208/309 |
| 4,810,367 | A | 3/1989 | Chombart et al. | |
| 4,816,140 | A | 3/1989 | Trambouze et al. | |
| 4,976,848 | A | 12/1990 | Johnson | |
| 4,990,243 | A | 2/1991 | Winslow et al. | |
| 5,059,304 | A | 10/1991 | Field | |
| 5,071,805 | A | 12/1991 | Winslow et al. | |
| 5,190,642 | A | 3/1993 | Wilson et al. | |
| 5,294,332 | A | 3/1994 | Klotz | |
| 5,310,479 | A | 5/1994 | Audeh | |
| 5,324,417 | A | 6/1994 | Harandi | |
| 5,356,813 | A | 10/1994 | Monticello | |
| 5,529,930 | A | 6/1996 | Monticello et al. | |
| 5,656,152 | A | 8/1997 | McLaughlin et al. | |
| 5,770,761 | A | 6/1998 | Lin et al. | |
| 5,961,821 | A | 10/1999 | Varadaraj et al. | |
| 6,160,193 | A | 12/2000 | Gore | |
| 6,171,478 | B1 | 1/2001 | Cabrera et al. | |
| 6,180,557 | B1 | 1/2001 | Choudhary et al. | |
| 6,274,785 | B1 | 8/2001 | Gore | |
| 6,277,271 | B1 | 8/2001 | Kocal | |
| 6,402,940 | B1 | 6/2002 | Rappas | |
| 6,406,616 | B1 | 6/2002 | Rappas et al. | |
| 6,596,914 | B2 | 7/2003 | Gore et al. | |
| 6,673,235 | B2 | 1/2004 | Harris et al. | |
| 6,955,753 | B1 | 10/2005 | Gomez | |
| 7,566,394 | B2 | 7/2009 | Koseoglu | |
| 2002/0035306 | A1 | 3/2002 | Gore et al. | |
| 2003/0006167 | A1 | 1/2003 | Han et al. | |
| 2003/0094400 | A1 | 5/2003 | Levy et al. | |
| 2004/0178122 | A1 | 9/2004 | Karas et al. | |
| 2004/0222134 | A1 * | 11/2004 | de Souza | 208/237 |
| 2005/0218038 | A1 | 10/2005 | Nero et al. | |
| 2006/0108263 | A1 | 5/2006 | Lin et al. | |
| 2006/0131214 | A1 | 6/2006 | de Souza et al. | |
| 2006/0272983 | A1 | 12/2006 | Droughton et al. | |
| 2007/0138060 | A1 | 6/2007 | Palmer et al. | |
| 2007/0140948 | A1 | 6/2007 | Palmer et al. | |
| 2007/0151901 | A1 | 7/2007 | Sain et al. | |
| 2009/0242459 | A1 | 10/2009 | Soloveichik et al. | |

FOREIGN PATENT DOCUMENTS

| | | | | |
|---|---|---|---|---|
| WO | 2005012458 | A1 | 2/2005 | |
| WO | 2006071793 | A1 | 7/2006 | |
| WO | 2007103440 | A2 | 9/2007 | |
| WO | 2007106943 | A1 | 9/2007 | |
| WO | WO2007/103440 | * | 9/2007 | C12N 9/74 |

* cited by examiner

SYSTEM AND PROCESS FOR INTEGRATED OXIDATIVE DESULFURIZATION, DESALTING AND DEASPHALTING OF HYDROCARBON FEEDSTOCKS

RELATED APPLICATIONS

This application is related to and claims priority from U.S. Provisional Patent Application Ser. No. 61/314,497 filed on Mar. 16, 2010, which is incorporated by reference herein in its entirety.

BACKGROUND OF THE INVENTION

1. Field of the Invention

This invention relates to a system and process for integrated desalting, deasphalting and desulfurization of hydrocarbon feedstocks.

2. Description of Related Art

In conventional oil refinery operations, various processes occur in discrete units and/or steps. This is generally due to the complexity of naturally occurring crude oil mixtures, and the fact that crude oil feedstocks processed at refineries often differ based on the location of the production well, the age of the production well, pre-processing activities at the production well, and the means used to transport the crude oil from the well to the refinery plant. Three very important and conventionally separate preliminary refining processes include desalting to reduce the level of inorganic salt dissolved in water entrained in the crude oil, desulfurization to reduce the organosulfur compounds present, and solvent deasphalting to separate the relatively heavy asphaltenic materials from a lighter deasphalted phase which is further refined into various petroleum products including transportation fuels. Prior methods or attempts to combine these processes are unknown to the inventors.

With respect to the salt content, a wide range of inorganic salt concentrations and compositions can be present in crude oil from sources in different parts of the world. The geologic formations from which crude is extracted influence the brine composition and concentration. Salt concentrations vary from merely brackish waters to highly concentrated solutions. The inorganic salt content of crude oils from the well can be in the range about 10-100,000 parts per million by weight (ppmw).

Salt in crude oil is dissolved in entrained water droplets. The salt composition in the brine can vary significantly. This is evidenced by wide ranges of calcium, sodium, magnesium, chloride, sulfate, and carbonate contents measured in crude oil brines around the world. For a specific crude oil mixture, salt content may correlate with bottoms, sediment, and water ("BS&W") content. However, such relationships have little significance for different crude oil mixtures, or for crude oil mixtures from the same geologic formation that are recovered using different production techniques.

Production of crude from new oilfields generally commences with inorganic salt concentrations of only a few ppmw. As the age of the production well increases, however, the crude salt content rises. Water flooding and $CO_2$ injection are principal secondary recovery techniques for continuing crude production from wells with declining crude flow. Crude oil produced by water flooding have higher than normal solids content and electrical conductivity, and are, therefore, more difficult to desalt. Injection of $CO_2$ containing gases tends to dissolve more calcium bicarbonate into the water entrained in the crude oil. These secondary recovery techniques, therefore, while increasing the overall productivity, impact the crude oil salt concentrations.

When secondary recovery becomes uneconomical, tertiary recovery methods are used, including steam injection and fireflooding. Fireflooding involves injecting air in the producing well and igniting it to stimulate the flow of crude and increase recovery. Crude oil from tertiary recovery operations, particularly fireflooding, is notoriously difficult to desalt.

Fundamental problems associated with salt contaminants in crude oil feedstocks include heat exchanger fouling, plugging and corroding of refinery equipment such as piping and pipe stills. Furthermore, chemical processing of the feedstock can be hindered by sodium poisoning of catalysts. Salts also promote problematic furnace tube fouling and coking. Therefore, crude oil desalting processes have been developed to minimize or avoid these problems.

Initial dehydration of crude oil from a production well usually takes place in the oilfield to reduce the volume of water moving through the transport system. Most crude oils can be electrostatically dehydrated to the 0.1% to 0.5% BS&W range. Some heavier, e.g., having an American Petroleum Institute gravity value of less than 20°, and more viscous crude oils, e.g., possessing a viscosity greater than about 18 Centistokes at the operating temperature, i.e., the initial electrostatic dehydration vessel in the oilfield, can only be reduced to the 0.5% to 5.0% BS&W range. Depending on the source of the crude oil, the amount of salt that is typically acceptable for export markets is about 30 ppmw. While this is not low enough to control the fouling and corrosion which is ultimately required in a refinery, it is sufficiently low such that most single-stage desalting operations can achieve acceptably low salt concentration levels.

The primary function of a desalting process is to remove this salt from water droplets in the oil. Other contaminants, such as sediment, which can also promote heat exchanger fouling, plugging, erosion, and residual product contamination, are also removed in a desalter. In general, desalting operations wash the crude oil feedstock with fresh water, and subsequently remove the water to provide dry, low salt crude oil. Electrostatic desalters are commonly used to create an electrical field which acts on the water droplets to enhance coalescence. Electrostatic desalting is also used to remove other particulates from crude oil. The mixture of crude oil and brine is contacted with fresh water using a mix valve upstream of a desalter vessel. Salt is extracted from the brine into the wash water droplets. Demulsifiers are often added to enhance contacting effectiveness, droplet coalescence, and water separation. The electric field in electrostatic desalters enhances water droplet coalescence so that water/oil separation requires much less residence time, and hence a smaller vessel, as compared to settling operations without the imposed electric field.

Crude oil typically also includes significant amounts of asphaltenic and resinous materials, which are used as asphalt cement. Solvent deasphalting is a well known process to separate asphaltenes and resins after atmospheric and vacuum distillation. The pitch product contains the majority of the contaminants of the residue, including metals, asphaltenes, and Conradson carbon, and is rich in aromatic compounds.

In general, the feed is mixed with light paraffinic solvents having a chain of 3-7 carbon atoms. Deasphalted oil is solubilized in the solvent, and the insoluble pitch precipitates. Separation of a deasphalted oil phase, including the mixture of solvent and deasphalted oil, and a pitch phase, occurs in an extractor. The extractor separates the two phases and minimizes contaminants trapped in the deasphalted oil. The deasphalted oil phase is then heated to conditions where the solvent becomes supercritical to facilitate separation of the solvent and deasphalted oil, whereby the solvent can be recovered for recycling. Solvent deasphalting processes are described, for instance, in U.S. Pat. Nos. 4,816,140, 4,810,367, 4,747,936, 4,572,781, 4,502,944, 4,411,790, 4,239,616, 4,305,814, 4,290,880, 4,482,453, 4,663,028, and 7,566,394, all of which are incorporated herein by reference.

In addition, crude oil commonly contains organosulfur compounds and heteroatom compounds such as those containing nitrogen. These compounds are generally undesirable and must be removed during refinery operations. Light crude oil or condensates contain sulfur as low as 0.01 weight %. In contrast, heavy crude oil can contain up to about 3 weight % organosulfur. Similarly, the nitrogen content of crude oils is in the range of 0.001-1.0 weight %. The heteroatom and carbon residue (measured as Ramsbottom carbon residue, or RCR) content of various Saudi Arabian crude oils are given in Table 1, where "ASL" refers to Arab Super Light, "AEL" refers to Arab Extra Light, "AL" refers to Arab Light, "AM" refers to Arab Medium and "AH" refers to Arab Heavy.

TABLE 1

| Property | ASL | AEL | AL | AM | AH |
|---|---|---|---|---|---|
| Gravity, ° | 51.4 | 39.5 | 33.0 | 31.1 | 27.6 |
| Sulfur, W % | 0.05 | 1.07 | 1.83 | 2.42 | 2.94 |
| Nitrogen, ppmw | 70 | 446 | 1064 | 1417 | 1651 |
| RCR, W % | 0.51 | 1.72 | 3.87 | 5.27 | 7.62 |
| Ni + V, ppmw | <0.1 | 2.9 | 21 | 34.0 | 67 |

The heteroatom content of crude oil generally increases with decreasing API gravity, or increasing heaviness, as is apparent from Table 1. The heteroatom content of the crude oil fractions also increases based on the boiling points of the fractions, as shown in Table 2.

TABLE 2

| Fractions, ° C. | Sulfur WT % | Nitrogen ppmw |
|---|---|---|
| C5-90 | 0.01 | |
| 93-160 | 0.03 | |
| 160-204 | 0.06 | |
| 204-260 | 0.34 | |
| 260-315 | 1.11 | |
| 315-370 | 2.00 | 253 |
| 370-430 | 2.06 | 412 |
| 430-482 | 2.65 | 848 |
| 482-570 | 3.09 | 1337 |

The discharge into the atmosphere of sulfur compounds during processing and end-use of the petroleum products derived from high organosulfur crude oil poses safety and environmental problems. In the industrialized countries of the United States, Japan and many countries of Europe, transportation fuel producers have already made necessary investments to reduce the sulfur content, and are producing environmentally clean transportation fuels. For instance, in 2007 the United States Environmental Protection Agency required sulfur content of highway diesel fuel to be reduced 97%, from 500 parts per million by weight (ppmw), referred to as low sulfur diesel, to 15 ppmw, referred to as ultra-low sulfur diesel. The European Union has enacted even more stringent standards, requiring diesel and gasoline fuels sold in 2009 to contain less than 10 ppmw of sulfur. Other countries are following in the footsteps of the United States and the European Union by establishing similar regulations that will require more refineries to produce low sulfur transportation fuels. The stringent sulfur specifications applicable to transportation and other fuel products have impacted the refining industry, and refiners must upgrade or replace existing refinery equipment to greatly reduce the sulfur content in fuel products.

Refractory sulfur compounds, which are considered very difficult to remove in hydrotreating processes conventionally employed for desulfurizing crude oil, include condensed-ring sulfur-bearing heterocyclic dibenzothiophene, shown below:

(1)

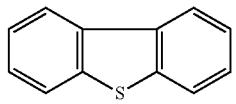

In addition, certain substituted dibenzothiophenes are particularly difficult to remove. A refractory sulfur compound, which is considered the most difficult to remove in processes employed for desulfurizing crude oil, include condensed-ring sulfur-bearing heterocyclic 4,6-dimethyldibenzothiophene, shown below:

(2)

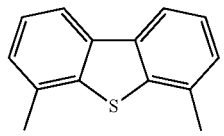

4,6-dimethyldibenzothiophene can account for a significant percentage of the total organic sulfur in hydrocarbon mixtures such as whole crude oil. This compound can account for as much as 90 ppmw of the total sulfur content of Arabian Light crude oil, as much as 110 ppmw of the total sulfur content of Arabian Medium crude oil, and as much as 108 ppmw of the total sulfur content of Arabian Heavy crude oil. Although these concentrations are relatively low, 4,6-dimethyldibenzothiophene is very difficult to remove during the hydrotreating process at mild hydrotreating conditions, e.g., 30 $Kg/cm^2$ pressure.

Oxidative desulfurization using liquid oxidizing agents in the presence of a catalyst, or combination of catalysts, is known to desulfurize dibenzothiophene and various substituted dibenzothiophenes including 4,6-dimethyldibenzothiophene, as well as other organosulfur compounds including, but not limited to, mercaptans and thiophenes. In these processes, the organosulfur compounds and, in certain processes, the organonitrogen compounds, are oxidized. The oxidation products are subsequently removed from the hydrocarbon product by extraction or other means. Oxidative desulfurization is described, for instance, in U.S. Pat. Nos. 6,160,193, 6,171,478, 6,274,785, 6,277,271, and 6,406,616, all of which are incorporated by reference herein.

It is desirable to remove at least some portion of the contaminants, including sulfur and nitrogen, during early processing steps in the refinery. Also, as discussed above, it is often necessary to desalt and deasphalt the crude oil during refinery operations in order to fraction the crude oil into useful products. However, conventional pretreatment desulfurization, desalting and deasphalting of crude oil generally requires separate and distinct process steps and associated unit operations equipment. For instance, in most refineries, desalting occurs upstream of atmospheric distillation, desulfurization is accomplished after distillation, and heavy distillation products are deasphalted. This means that during fractionating, a desalted stream, which contains organosulfur compounds and asphaltenes, is carried and subsequently converted or separated. Consequently, the distillation equipment and pre-distillation equipment must be sized and designed to accommodate the total volume, as well as chemical and physical attributes of a hydrocarbon mixture having asphaltenes and organosulfur compounds.

A combined process for the desalting and reducing the concentration of sulfur-bearing molecules is disclosed in U.S. Pat. No. 5,356,813. The crude, bacterial culture, oxygen and water are introduced into a stirred incubator vessel for a period of time and under conditions that permit the bacteria to cleave the sulfur-carbon bonds and form an inorganic, water soluble sulfate. In the process postulated, the bacteria is to be prepared by fermentation in a separate bioreactor under aerobic conditions that requires a nutrient medium which contains carbon, such as glycerol or glucose. As will be understood by one of ordinary skill in the art, the practice of the process disclosed in U.S. Pat. No. 5,356,813 requires biofermenting apparatus and associated technology not typically found in crude oil production and refining facilities. The desalting process is commonly performed in the field close to the wellhead or well collection point. Biofermenting apparatus are typically costly to acquire and maintain and require specific controls. In addition, engineering and technical personnel familiar with oilfield and refinery unit operations will not be knowledgeable about biochemical operations and equipment. It is also not clear whether the sole bacterial culture identified would be effective in the presence of the numerous other mineral salts that are typically found in crude oil. Furthermore, the temperature range recited in the patent of 10-60° C. for operation of the crude oil desalting and desulfurization vessel is substantially lower than the temperature of crude oil at the well head, and the cost of installing, operating and maintaining cooling equipment constitutes another disadvantage of the process. The requirement to reheat the crude oil for transport and subsequent processing is yet another cost factor detracting from practical commercial application of the process of U.S. Pat. No. 5,356,813.

Accordingly, a need exists for an efficient and effective method for desulfurization, desalinization and deasphalting of hydrocarbons, such as crude oil. As petroleum companies look to economize in light of increased processing costs, as well as more stringent worldwide regulations, this need becomes more urgent. The elimination or minimization of equipment presently used for desulfurization and desalinization, or consolidation of the existing equipment, to increase efficiency and lower costs, would be desirable.

Therefore, it is an object of the present invention to provide an integrated desulfurization, desalting and deasphalting process that can be practiced without addition to existing facilities of costly equipment, hardware and control systems.

It is another object of the present invention to provide an integrated desulfurization, desalting and deasphalting process that requires minimal modification of existing facilities.

It is still another object of the present invention to provide a hydrocarbon mixture to pre-distillation and distillation processes that has a reduced volume and a lesser chemical and physicochemical impact on existing processes.

SUMMARY OF THE INVENTION

The above objects and further advantages are provided by the system and process for integrated desalting, deasphalting and desulfurization of hydrocarbon feedstocks. In one embodiment of the invention, a hydrocarbon feedstock, a water soluble oxidant, a water soluble catalyst, and wash water are introduced in a desalting zone, in which the contents are retained for a period of time sufficient to achieve the desired degree of desulfurization and desalting. Catalyst and dissolved salt are discharged along with the wastewater effluent, and a hydrocarbon stream including converted hydrocarbons and oxidation by-products is passed to a deasphalting zone. In the deasphalting zone, phase separation occurs, whereby a light phase including desulfurized hydrocarbons are produced, and a heavy phase including asphaltenes and oxidation by-products are discharged, e.g., passed to an asphalt pool.

In another embodiment of the present invention, a hydrocarbon feedstock, a water soluble oxidant, and a water soluble catalyst are introduced in an oxidation zone, in which the contents are retained for a period of time sufficient to achieve the desired degree of desulfurization. The mixture including converted hydrocarbons and oxidation by-products is passed to a desalting zone, along with wash water. Water containing salt and catalysts are removed from the desalting zone, and the desalted hydrocarbon mixture containing converted hydrocarbons and oxidation by-products is passed to a deasphalting zone. In the deasphalting zone, phase separation occurs, whereby a light phase including desulfurized hydrocarbons are produced, and a heavy phase including asphaltenes and oxidation by-products are discharged.

Advantageously, the embodiments of the present invention integrate unit operations commonly found in existing refineries, and uses them in a way that achieves desulfurization, desalting and deasphalting in a combined, efficacious and efficient manner. Additional processes and operations that are required in prior art systems for desulfurization, including an extraction step that is commonly found with oxidative desulfurization operations, can be avoided, as oxidation by-products including sulfoxides and/or sulfones are removed in the deasphalting zone.

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figure 1:
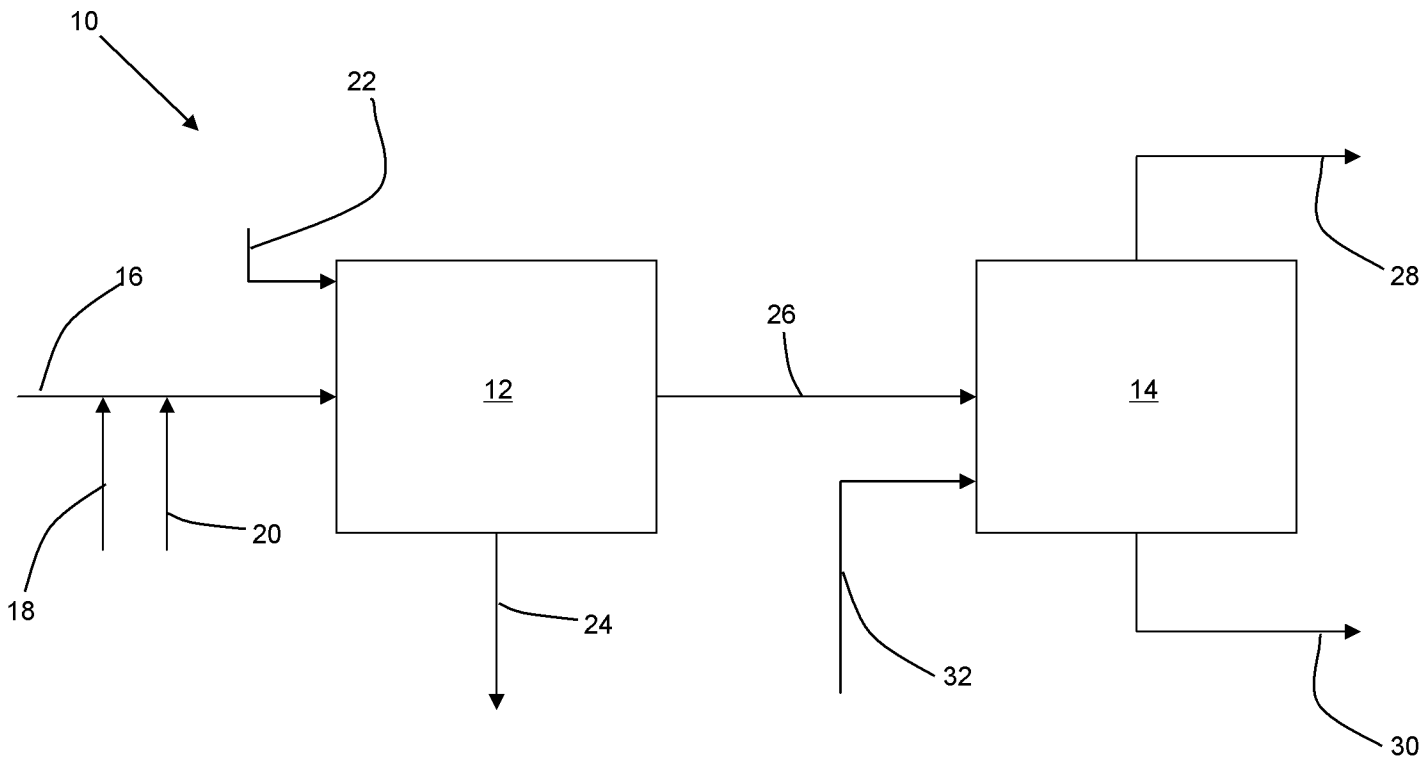
FIG. 1 is a schematic diagram of an integrated oxidative desulfurization and desalting system and process of the present invention.

Referring to FIG. 1, a system and process for combined desulfurization and desalting is shown. The system 10 generally includes a desalting zone 12 and a deasphalting zone 14. A hydrocarbon feedstock 16 is introduced to the desalting zone 12, along with an aqueous oxidant and a catalyst, e.g., at inlet locations 18, 20, respectively. The hydrocarbon feedstock can be naturally occurring hydrocarbons including crude oil, bitumens, heavy oils, or shale oils, or hydrocarbon mixtures derived from refinery process units including hydrotreating, hydroprocessing, fluid catalytic cracking, coking, and visbreaking or coal liquification. In general, the hydrocarbon feedstock has a mixture of hydrocarbon compounds with boiling points in the range 36° C. to 1500° C., and contains impurities including sulfur and nitrogen compounds, nickel, vanadium, iron, and molybdenum, which is typical for crude oil sources.

Note that although aqueous oxidant and catalyst are illustrated as separate feeds, they can optionally be combined as a single feed into the hydrocarbon feedstock stream 16. Further, the aqueous oxidant and catalyst, separately or in combination, may be directly introduced into the desalting zone 12. For instance a molar ratio of oxidant, e.g. $H_2O_2$, to sulfur compounds present in the feedstock ($H_2O_2$:S) can be between about 2:1 to about 50:1 mol/mol ratio, preferably about 4:1 to about 10:1 mol/mol ratio. Catalyst can be introduced in proportions of about 0.0015 weight % to about and 20 weight %, preferably about 0.005 weight % to about 2 weight % based on the feedstock mass flow rate. In the desalting zone 12, salt that is present in the hydrocarbon feed 16 is washed with water.

In addition, according to the present invention, hydrocarbons containing heteroatoms including, but not necessarily limited to, organosulfur and organonitrogen compounds, are oxidized into oxidation products by virtue of their reaction with the oxidizing agents in the presence of the catalysts. The products of the oxidation reactions include converted hydrocarbons compounds, which are generated from organosulfur and organonitrogen compounds, sulfoxides and/or sulfones as by-products of the organosulfur oxidation reactions.

The source of water can be water from the aqueous oxidant, additional water that is introduced at location 22, or both. The volume of water can be determined by one of ordinary skill in the art based on the desired level of desalting. Furthermore, according to the present invention, the volume of water can be adjusted based on the quantity of aqueous oxidant and the solubility of the oxidation by-products.

The contents of the desalting zone 12 are mixed and remain in contact under conditions suitable for promoting the oxidation reactions for a period of time that is sufficient to complete the desired degree of desulfurization and denitrogenation, and the desired level of desalting, as determined, for example, by testing of samples recovered from via a collection probe using appropriate analytical apparatus (not shown). The mixing time can also be predetermined based on experience and the known concentrations of the undesired compounds. In general, the contents can be mixed for a period of about 10 to about 60 minutes, preferably at least about 15 minutes.

After suitable mixing, the contents of the desalting zone 12 are allowed to separate into a desalted layer, including converted hydrocarbons, i.e., oxidized sulfur and nitrogen by-products, and a lower aqueous layer containing mostly salt, water and catalyst. Depending upon the nature of the emulsion formed, chemical additives can be introduced to break the emulsion more rapidly and to facilitate the formation of a distinct oil/water separation layer. The chemical additives and their methods of addition are known to those of ordinary skill in the art, and are generally selected from chemical additives used to break oil-water emulsions when water is contained in the hydrocarbon feedstock.

Figure 3A:
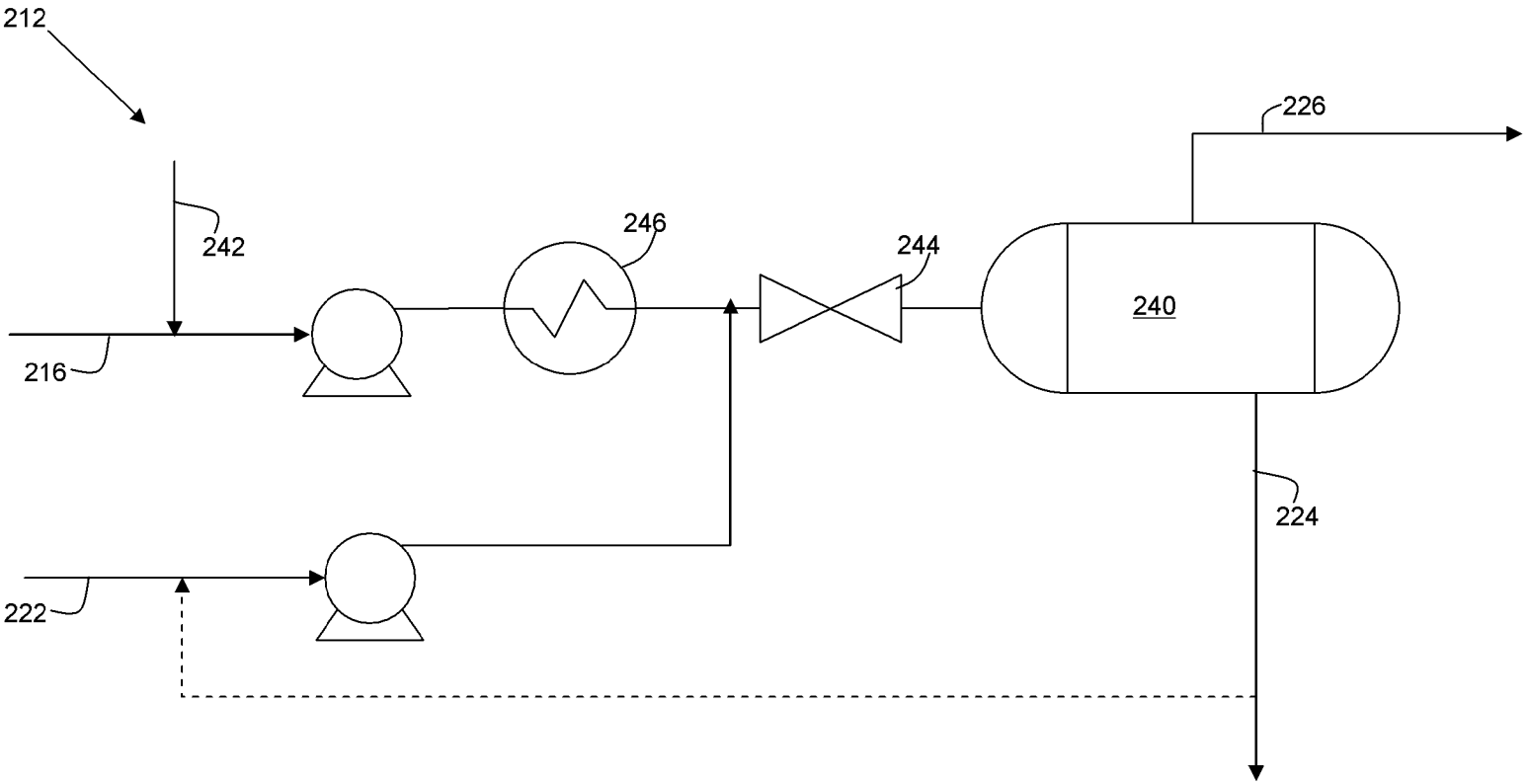
FIGS. 3A-3B are schematic diagrams of desalting processes that can be employed in the integrated oxidative desulfurization and desalting systems and processes of the present invention.

In one preferred embodiment, the desalting apparatus is an aqueous desalting apparatus. Aqueous desalting involves washing the hydrocarbon feedstock with a predetermined volume or ratio of water after first heating the salt-containing hydrocarbon mixture to reduce its viscosity and surface tension and for ease in mixing which facilitates the later separation of the aqueous component. The upper temperature range depends on the type of hydrocarbon mixture being treated. An aqueous solution is added and the mixture passes through a mixing valve, or is directly added to a suitably agitated vessel such as a continuously stirred tank reactor or other type of vessel used in aqueous desalting operations that achieves intimate contact of the water with the hydrocarbon mixture. Chemical additives are typically used to adjust the pH of the wash water to enhance solubilization of the salt in the aqueous phase. In other embodiments, described in further detail below with reference to FIGS. 3A-3B, electrostatic desalting systems are used.

After desalting and desulfurizing reactions are completed, the mixing of the hydrocarbons is stopped and the wash water is allowed to settle. In electrostatic desalting, the settling vessel is equipped with electrodes to produce a high voltage electrostatic field. The electrostatic field aids water droplet agglomeration and settling. The desalted/desulfurized hydrocarbon mixture is removed from the top of the settling vessel as effluent 26. Wash water, salt and catalysts are discharged from the bottom generally as a wastewater stream 24. Additional stages can be used to achieve any additional desired reduction of solids and other contaminants.

With continued reference to FIG. 1, hydrocarbon stream 26 containing oxidation products (including sulfoxides, sulfones, and converted hydrocarbons) is then sent to the solvent deasphalting zone 14 for phase separation into a lighter phase and heavier phase, via outlets 28, 30, respectively. The lighter phase 28 includes the deasphalted and demetallized hydrocarbon product, which can be passed to further refinery operations (not shown). The heavier phase 30 includes oxidation by-products and asphaltenes, in which organometallics are also present, and which can be used as asphalt product. Deasphalting zone 14 can be any well known separator or vessel used conventionally for solvent deasphalting. In certain preferred embodiments, paraffinic solvents, which are non-polar, are used in solvent deasphalting. Accordingly, oxidation by-products, which are generally polar, will not be significantly soluble in the non-polar solvent.

Figure 2:
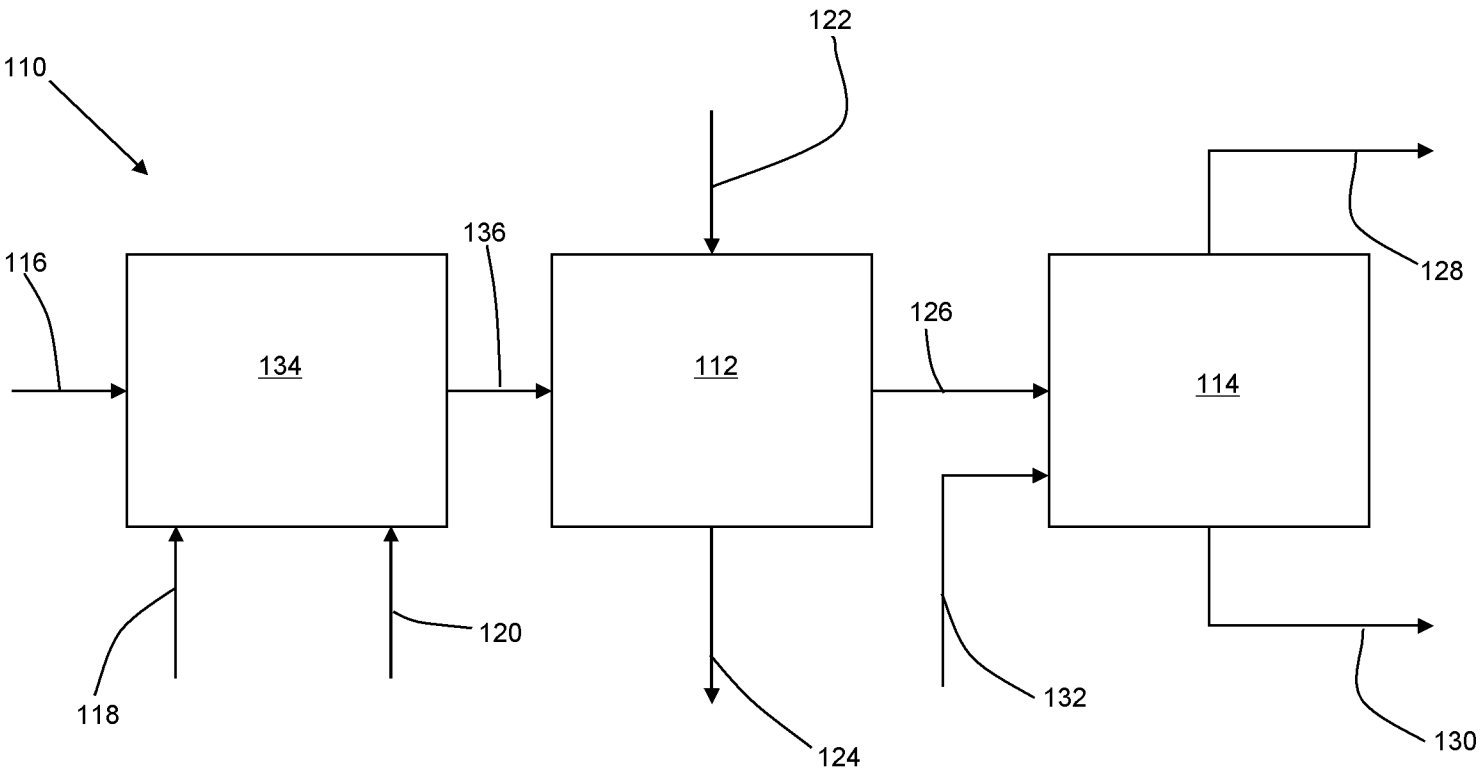
FIG. 2 is a schematic diagram of another embodiment of an integrated oxidative desulfurization and desalting system and process of the present invention.

Referring now to FIG. 2, a hydrocarbon feedstock 116, an aqueous oxidant 118 and a catalyst 120 are introduced to an oxidation zone 134 for reaction. The oxidation zone 134 can include a vessel that is equipped with one or more of any conventional known mixing means, such as a batch reactor with a mixer, an ebullated bed reactor, a slurry bed reactor or a tubular reactor. The contents of the oxidation zone 134 are mixed and remain in contact under conditions suitable to promote oxidation reactions for a period of time that is sufficient to achieve the desired degree of desulfurization. In general, the contents can be mixed for a period of about 10 to about 60 minutes, preferably at least about 15 minutes.

An effluent stream 136 containing oxidized hydrocarbons and water is passed to a desalting zone 112 where salt that is present in the hydrocarbons is washed with water. The effluent stream from the separate oxidation zone 134 is sent to the desalting zone 112 to desalt and demulsify the water-oil mixture, and to separate catalysts and water. As with the embodiment described and illustrated in FIG. 1, the source of water can be the water of the aqueous oxidant 118, an additional water feed 122, or both. In addition, hydrocarbons containing heteroatoms, including but not necessarily limited to, organosulfur and organonitrogen compounds, are oxidized into oxidation products due to reaction with the oxidizing agents in the presence of the catalysts.

The contents of the desalting zone 112 are allowed to separate into a desalted layer, including converted hydrocarbons, i.e., oxidized sulfur and nitrogen by-products, and a lower aqueous layer containing mostly salt, water and catalyst. Chemical additives can optionally be added to facilitate demulsification and formation of a distinct oil/water separation layer. As described above, the desalting apparatus can be an aqueous desalting apparatus or an electrostatic desalting apparatus as are known to those of ordinary skill in the art.

Water containing salts and catalysts are discharged as wastewater via an outlet 124. The hydrocarbon stream 126 containing oxidation products (including sulfoxides, sulfones, and converted hydrocarbons) is then sent to a solvent deasphalting zone 114 for separation into a lighter phase and a heavier phase via outlets 128, 130, respectively. The lighter phase includes the deasphalted and demetallized hydrocarbon product, and the heavier phase includes asphaltenes and oxidation by-products.

The mechanism for separating brine from desalted oil can vary based upon the selected desalting apparatus and process. For instance, an electrostatic desalting process can be employed to separate brine from oil. In a single-stage electrostatic desalting process, and referring now to FIG. 3A, a single stage electrostatic desalting zone 212 generally includes an electrostatic desalter 240 and an upstream mix valve 244. In one embodiment of the present invention, a hydrocarbon feed stream 216 and an influent 222 including aqueous oxidant, catalyst, and optionally wash water, are transferred, e.g., via suitable pumping apparatus, to the mix valve 244 for mixing upstream of the electrostatic desalter 240. Oxidation of organosulfur compounds occurs in the desalter 240, as described with respect to FIG. 1. In certain embodiments, the brine effluent 224 from the desalter 240 can be used as a source of water for the aqueous oxidant by combining a portion of the effluent 224 with the influent 222 in embodiments in which oxidation occurs in the desalter 240.

In another embodiment of the present invention, the hydrocarbon feed, aqueous oxidant and catalyst are introduced to a separate oxidation vessel upstream of the desalting zone 212, as described above with respect to FIG. 2, whereby the hydrocarbon feed stream includes oxidation by-products and converted hydrocarbons. In embodiment in which a wash water supply via inlet 222 is insufficient, a portion of brine effluent 224 from the electrostatic desalter 240 can be used as a source of water for the aqueous oxidant by combining a portion of the effluent 224 with the influent 222.

A demulsifier composition can also optionally be introduced to the hydrocarbon feed stream 216 upstream of mix valve 244, e.g., at location 242. The demulsifier composition can be one or more chemical desalting aids which is added to enhance contact effectiveness, droplet coalescence, and water separation. One or more heat exchangers 246 can also be provided between the location 242 where the demulsifier composition is added, and the location 222 where water is introduced, to heat the hydrocarbon feed 216.

A mixed effluent 226 including desalted oil and the oxidation products are separated from the top of the electrostatic desalter 240, and passed to a suitable deasphalting apparatus, as shown in FIG. 1 or 2, e.g., deasphalting zones 14 or 114, respectively. Water effluent 224 containing catalyst and water having dissolved salts is discharged from the bottom of vessel 240. As described above, portion of the discharged water can be used as a source of water for the aqueous oxidant.

Figure 3B:
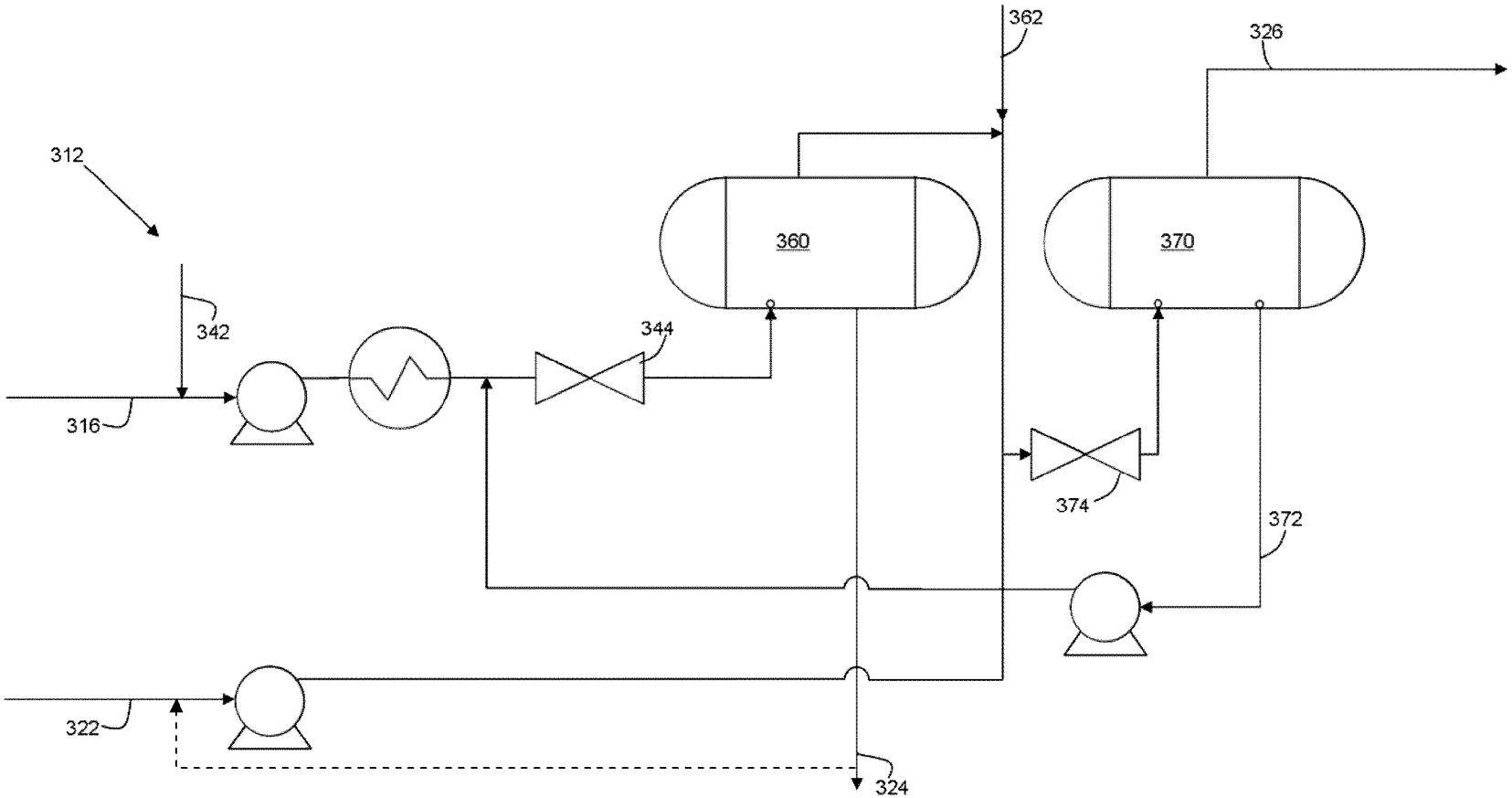

In another type of a desalting process, schematically illustrated in FIG. 3B, a two-stage electrostatic desalting zone 312 includes a first stage desalter 360 and a second stage desalter 370. Since large quantities of suitable wash water are often unavailable at many refineries, typical two-stage desalters are countercurrent processes, where fresh water 322 is added at a mix valve 374 and introduced to a second stage desalter 370, and effluent water 372 from the second stage desalter 370 is introduced upstream of a mix valve 344 as wash water for the first stage desalter 360. A demulsifier composition can be introduced upstream of the first stage desalter 360 at location 342. Depending upon the nature of the demulsifier composition, it can also be included upstream of the second stage desalter 370 at location 362. Effluent waste water 324 is removed from the first stage desalter 360.

In one embodiment of the present invention, a hydrocarbon feed stream 316, aqueous oxidant and catalyst are introduced to the mix valve 344 for contacting upstream of the first electrostatic desalter 360. Oxidation of organosulfur and organnitrogen compounds occurs in the first stage desalter 360, as described with respect to FIG. 1 and, depending on the process conditions and residence time in the first stage desalter 360, oxidation can continue in the second stage desalter 370. In another embodiment of the present invention, the hydrocarbon feed, aqueous oxidant and catalyst are introduced to a separate oxidation vessel upstream of the desalting zone 312 whereby the hydrocarbon feed stream includes oxidation by-products and converted hydrocarbons.

Any combination of oxidant and catalyst which accomplishes the conversion of a significant proportion of the organosulfur and organnitrogen compounds in a hydrocarbon mixture while in the high salt environment of the aqueous desalting process can be used in the process of the present invention. The oxidizing agent and catalyst are generally selected to be water soluble at temperatures of about 20° C. to about 100° C., pressures of about 1 kilograms per square centimeter to about 30 kilograms per square centimeter, and residence times of about 1 minute to about 100 minutes. Preferred oxidants are hydrogen peroxide, water soluble organic peroxides, or a combination of hydrogen peroxide and water soluble organic peroxides. Organic peroxides can be selected from the group consisting of alkyl hydroperoxides, aryl hydroperoxides, dialkyl peroxides, diaryl peroxides, or a combination comprising at least one of the foregoing organic peroxides. The dialkyl and diaryl peroxides have the general formula $R_1$—O—O—$R_2$, wherein $R_1$ and $R_2$ are the same or different alkyl groups or aryl groups.

Preferred catalysts are homogeneous catalysts having active species selected from the group consisting of Mo (VI), W (VI), V (V), Ti (IV), and combinations comprising at least one of the foregoing active species, possessing high Lewis acidity with weak oxidation potential. In certain embodiments, heterogeneous catalysts or catalysts mixtures can also be used, whereby excess solids can be incorporated in the asphalt phase, up to about 10 weight %.

In addition to providing an oxidizing agent in the form of hydrogen peroxide or other peroxide compound(s), gaseous oxygen can be provided. The oxygen gas can be supplied prior to or during the mixing, using conventional bubbling or sparging techniques. The oxidant can be oxygen, air, nitrous oxide and/or combination thereof.

The rate of desulfurization can be enhanced by conducting the reaction at a predetermined optimum temperature range. Temperatures between about 30° C. and 110° C. are preferred. However, the process can be operated any temperature at which the hydrocarbon mixture is received and can be mixed with the desalting water.

Accordingly, the present invention achieves the objects of providing an integrated desulfurization, desalting and deasphalting system process that can be practiced without the requirement to substantially modify existing facilities by adding costly equipment, hardware and control systems. Furthermore, the hydrocarbon mixture that must be subjected to pre-distillation and distillation processes has a reduced volume and a lesser chemical and physicochemical impact on existing processes, as organosulfur and organonitrogen compounds are converted to hydrocarbons free of heteroatoms, asphaltenes and organometallic compounds are discharged with the heavy phase in the deasphalting zone, and salt entrained in water is removed.

Unit operations commonly found in existing refineries are advantageously combined and employed in a manner that that achieves desulfurization, desalting and deasphalting with an increase in efficacy and efficiency.

Furthermore, unlike conventional oxidative desulfurization processes that must use separate unit operations to extract sulfur by-products, the system and method of the present invention uses the deasphalting zone to perform this requisite step.

EXAMPLE

A bunker fuel oil containing 70% visbroken and vacuum residue and 30% hydrocracker bottoms, diesel and kerosene having a density of 0.96 Kg/L and a viscosity of 173.5 cSt was oxidatively desulfurized. Composition and properties of the bunker fuel oil are given in Table 3:

TABLE 3

| Feed | Units | Value |
|---|---|---|
| Sulfur | W % | 3.47 |
| Nitrogen | ppmw | 410 |
| Density | Kg/L | 0.9586 |
| Viscosity | cSt | 173.5 |
| Salt | ppmw | <10 |
| IBP | ° C. | 118 |
| 5% | | 189 |
| 10% | | 241 |
| 20% | | 318 |
| 30% | | 378 |
| 40% | | 421 |
| 50% | | 457 |
| 70% | | 531 |
| 90% | | 639 |
| 95% | | 682 |
| FBP | | 760 |

The bunker fuel oil contained 3.5 W % sulfur, 410 ppmw nitrogen, 17 ppmw nickel and 58 ppmw vanadium. The bunker fuel oil was composed of 83.5 W % lean oil (having 31.4 W % saturates and 52.1 W % of aromatics) and 16.5 W % bottoms (having 8.9 W % of resins and 7.7 W % of asphaltenes) as determined according the saturates, aromatics, resins, and asphaltenes (SARA) analysis method. According to this method, the asphaltenes were separated by contacting the oil with pentane in excess concentration (300:1 pentane to oil ratio) at room temperature and atmospheric pressure for 24 hours. The saturates fraction was obtained by eluting the maltene fraction over a silica gel column with 17-230 mesh size at an adsorbent to liquid ratio of 1000 using pentane as solvent. The aromatics fraction was eluted using a 50:50 V %:V % mixture of pentane and dichloromethane. The resins were obtained using a 15:15:70 V %:V %:V % mixture of methane, acetone and chloroform.

The feedstock was oxidatively desulfurized in a laboratory vessel simulating oxidation/desalting and solvent deasphalting steps. Polyoxoanions obtained by combining sodium tungsten $Na_2WO_4$, $2H_2O$ with acetic acid are used as a catalytic system. A 30% $H_2O_2/H_2O$ solution is used as an oxidizing agent. The amount of the oxidant was selected so that the molar ratio of oxidant to S is about 5:1. The oxidation reactions were carried out at 70° C. and 1 atm for 1.5 hours. During the oxidation reaction, sulfur-containing species are converted to their corresponding oxidation products (sulfones), which are polar in nature and as a result the oxidized sulfur compounds shifted to the bottoms products, i.e., aqueous phase.

The mixture was initially composed of the aqueous oxidant phase and the organic oil phase. A single liquid phase was observed when the reaction medium was cooled to room temperature. A centrifuge was used in order to simulate performance of a desalter to separate oil and water phases. Since the feedstock contained less 10 ppmw salt, no actual desalting was required. The obtained solution was transferred into a centrifugal tube and centrifuged for about 20 minutes at 50° C. and 25,000 rpm. This resulted in phase separation of an oil phase on the top and an aqueous phase on the bottom of the tube.

A solvent deasphalting step was conducted following the procedure used during the SARA analysis. The asphaltenes were thus separated by contacting the oil with pentane in excess concentration (300:1 pentane to oil ratio) at room temperature and atmospheric pressure for 24 hours. The resins were separated from the maltene fraction over a silica gel column (17-230 mesh size at an adsorbent to liquid ratio of 1000) using a 15:15:70 V %:V %:V % mixture of methanol, acetone and chloroform. The material balance for the overall process is provided in Table 4, with the reference numbers based on those in the embodiment described above with respect to FIG. 1. The process yielded 41.7 W % fuel oil containing 0.17 W % sulfur.

TABLE 4

| | | Stream Name | | | | | | |
|---|---|---|---|---|---|---|---|---|
| | | Feedstock | Catalyst | Oxidant | Fuel Oxidized | Catalyst | Deasphalted Oil | Asphalt |
| | | Stream Type | | | | | | |
| | | Feed | Catalyst | Oxidant | Product | Waste | Product | By-Product |
| | | Stream Number | | | | | | |
| | Unit | 16 | 18 | 20 | 26 | 24 | 28 | 30 |
| In-Out | | In | In | In | Out | Out | | |
| Phase | | HC | AQ | AQ | HC | AQ | | |
| Fuel | g | 1000 | | | 1000 | | 417.8 | 583 |
| Fuel Reject | g | | | | | | | |
| Acetic Acid | g | | 60 | | 18.5 | 41.5 | | |

TABLE 4-continued

| | | Stream Name | | | | | | |
|---|---|---|---|---|---|---|---|---|
| | | Feedstock | Catalyst | Oxidant | Fuel Oxidized | Catalyst | Deasphalted Oil | Asphalt |
| | | Stream Type | | | | | | |
| | | Feed | Catalyst | Oxidant | Product | Waste | Product | By-Product |
| | | Stream Number | | | | | | |
| | Unit | 16 | 18 | 20 | 26 | 24 | 28 | 30 |
| $H_2O_2$ | g | | | 184.5 | 0 | 24 | | |
| $H_2O$ | g | | 430.5 | | 171.5 | 410 | | |
| $Na_2WO_4$ | g | | 8 | | 5.5 | 2.5 | | |
| Methanol | g | | | | | | | |
| Oxygen | g | | | | | | | |
| Loss | g | | | | 0 | | | |
| Total | g | 1000 | 498.5 | 184.5 | 1145 | 478 | | |
| 0 | 0 | | | | | | | |
| Properties | 0 | | | | | | | |
| Density | Kg/L | 0.9586 | | | | | | |
| S | Wt, % | 3.475 | | | 3.035 | 0 | 0.17 | 5.923 |
| N | ppmw | 410 | | | 358 | 0 | | |

The method and system of the present invention have been described above and in the attached drawings; however, modifications will be apparent to those of ordinary skill in the art and the scope of protection for the invention is to be defined by the claims that follow.

What is claimed is:

1. A process for reducing the concentration of organosulfur compounds, salt and asphaltenes in a hydrocarbon mixture containing organosulfur compounds, salt and asphaltenes, the process occurring within a refinery and comprising:

a) contacting the hydrocarbon mixture with a water soluble oxidant and a water soluble catalyst in a desalting zone within the refinery;

b) introducing wash water into the desalting zone;

c) retaining the oxidant, catalyst and wash water in the desalting zone with the hydrocarbon mixture for a period of time to oxidize the organosulfur compounds to form converted hydrocarbons and oxidation by-products including sulfoxides and/or sulfones;

d) removing water containing salt and catalysts from the desalting zone;

e) passing the desalted hydrocarbon mixture containing oxidation products including converted hydrocarbons and oxidation by-products to a deasphalting zone within the refinery; and f) separating, in the deasphalting zone, a product stream containing desalted, desulfurized and deasphalted hydrocarbons, including converted hydrocarbons, and an asphaltene stream including asphaltenes and oxidation by-products.

2. A process for reducing the content of organosulfur compounds, salt and asphaltenes in a hydrocarbon mixture containing organosulfur compounds, salt and asphaltenes, the process occurring within a refinery and comprising:

a) contacting the hydrocarbon mixture with water soluble oxidant and water soluble catalyst in an oxidation zone within the refinery;

b) agitating the hydrocarbon mixture, the oxidant and the catalyst in the oxidation zone for a period of time sufficient to oxidize the organosulfur compounds to form converted hydrocarbons and oxidation by-products including sulfoxides and/or sulfones;

c) passing the hydrocarbon mixture including converted hydrocarbons and oxidation by-products from the oxidation zone to a desalting zone within the refinery;

d) introducing wash water to the desalting zone;

e) removing water containing salt and catalysts from the desalting zone;

f) passing the desalted hydrocarbon mixture containing converted hydrocarbons and oxidation by-products to a deasphalting zone within the refinery; and g) separating, in the deasphalting zone, a product stream containing desalted, desulfurized and deasphalted hydrocarbons, including converted hydrocarbons, and an asphaltene stream including asphaltenes and oxidation by-products.

3. The process of claim 1, wherein the oxidant is hydrogen peroxide.

4. The process of claim 1, wherein the oxidant is a water soluble organic peroxide.

5. The process of claim 4, wherein the organic peroxide is selected from the group consisting of alkyl hydroperoxides, aryl hydroperoxides, dialkyl peroxides, and diaryl peroxides.

6. The process of claim 4, wherein the organic peroxide has the general formula.

$$R_1—O—O—R_2,$$

wherein $R_1$ and $R_2$ are the same or different alkyl groups or aryl groups.

7. The process of claim 1, wherein the oxidant is selected from the group consisting of one or more hydrocarbon peroxides, a water soluble organic peroxide, and a combination of one or more hydrocarbon peroxides and a water soluble organic peroxide.

8. The process of claim 1, wherein the catalyst is a transition metal catalyst.

9. The process of claim 8, wherein the transition metal catalyst is selected from the group of catalysts consisting of Mo, W, V, Ti, and a combination including at least one of Mo, W, V, and Ti.

10. The process of claim 1, wherein the hydrocarbon mixture is selected from the group consisting of crude oil, bitumens, heavy oil, shale oil, a hydrotreated product, a hydroprocessing product, a fluid catalytic cracking product, a coking product, a visbreaking product, a coal liquification product, and combinations thereof.

11. The process of claim 1, wherein the hydrocarbon mixture contains organonitrogen compounds which are oxidized with the organosulfur compounds to produce oxidation products, the oxidation products being hydrocarbons derived from the organonitrogen compounds.

12. The process of claim 1, wherein the ratio of oxidant to sulfur compounds present in the initial hydrocarbon mixture is about 2:1 to about 50:1 mol:mol.

13. The process of claim 1, wherein the ratio of oxidant to sulfur compounds present in the initial hydrocarbon mixture is about 4:1 to about 10:1 mol:mol.

14. The process of claim 1, wherein catalyst is introduced in a quantity of 0.0015 weight % to about 20 weight % based on the flow rate of the hydrocarbon mixture.

15. The process of claim 1, wherein catalyst is introduced in a quantity of 0.005 weight % to about 2 weight % based on the flow rate of the hydrocarbon mixture.

16. A system within a refinery for reducing the concentration of organosulfur compounds, salt and asphaltenes in a hydrocarbon mixture containing organosulfur compounds, salt and asphaltenes, the system comprising:

a desalting zone within the refinery for receiving a hydrocarbon mixture, water soluble oxidant, water soluble catalyst and wash water, retaining the contents for a period of time to oxidize the organosulfur compounds to form converted hydrocarbons and oxidation by-products including sulfoxides and/or sulfones, discharging water containing salt and catalysts, and discharging a desalted hydrocarbon mixture containing oxidation products including converted hydrocarbons and oxidation by-products to a deasphalting zone; and a deasphalting zone within the refinery in fluid communication with the desalting zone for receiving the desalted hydrocarbon mixture, phase separating the desalted hydrocarbon mixture, discharging a product stream containing desalted, desulfurized and deasphalted hydrocarbons, including converted hydrocarbons, and discharging an asphaltene stream including asphaltenes and oxidation by-products.

17. A system within a refinery for reducing the content of organosulfur compounds, salt and asphaltenes in a hydrocarbon mixture containing organosulfur compounds, salt and asphaltenes, the system comprising:

an oxidation zone within the refinery for receiving the hydrocarbon mixture, water soluble oxidant and water soluble catalyst, and agitating the contents for a period of time sufficient to oxidize the organosulfur compounds to folin converted hydrocarbons and oxidation by-products including sulfoxides and/or sulfones;

a desalting zone within the refinery in fluid communication with the oxidation zone for receiving a reduced organosulfur compound hydrocarbon mixture and oxidation by-products, receiving wash water, discharging water containing salt and catalysts, and discharging the desalted hydrocarbon mixture containing converted hydrocarbons and oxidation by-products; and a deasphalting zone within the refinery in fluid communication with the desalting zone for receiving the desalted hydrocarbon mixture, phase separating the desalted hydrocarbon mixture, discharging a product stream containing desalted, desulfurized and deasphalted hydrocarbons, including converted hydrocarbons, and discharging an asphaltene stream including asphaltenes and oxidation by-products.

* * * * *